US006685068B1

(12) United States Patent
Thompson et al.

(10) Patent No.: US 6,685,068 B1
(45) Date of Patent: Feb. 3, 2004

(54) CARRYING CASE FOR AN INHALER

(76) Inventors: Brian E. Thompson, 901 S. Butternut Pl., Broken Arrow, OK (US) 74012; Kevin B. Raley, 3467 S. Gary Ave., Tulsa, OK (US) 74105

( * ) Notice: Subject to any disclaimer, the term of this patent is extended or adjusted under 35 U.S.C. 154(b) by 105 days.

(21) Appl. No.: 09/974,075

(22) Filed: Oct. 10, 2001

(51) Int. Cl.[7] ..... A45F 5/00
(52) U.S. Cl. ..... 224/251; 224/250; 224/269
(58) Field of Search ..... 224/148.6, 219, 224/222, 250, 251, 267, 269

(56) References Cited

U.S. PATENT DOCUMENTS 5,002,214 A * 3/1991 Caranci ..... 224/240
5,779,122 A * 7/1998 Martinelli ..... 224/240
5,833,093 A * 11/1998 Honaker et al. ..... 224/269
D404,562 S 1/1999 Brown et al. ..... D3/215
5,855,307 A * 1/1999 Biddick et al. ..... 224/250
6,196,431 B1 * 3/2001 Underhill ..... 224/240
6,360,929 B1 * 3/2002 McCarthy ..... 224/251
6,474,520 B1 * 11/2002 Finkelstein ..... 224/267

* cited by examiner

*Primary Examiner*—Gary E. Elkins
(74) *Attorney, Agent, or Firm*—Frank J. Catalano

(57) ABSTRACT

A case carries an inhaler holding a canister of medicant. An elastically radially deformable cylindrical sleeve is resiliently expandable to slidably axially receive and grip the inhaler. An elastically lengthwise deformable strap stretches diametrically across the sleeve to secure the canister against inadvertent release from the inhaler. A spring clip is connected to the sleeve by a loop for attaching and detaching the case to and from an external object such as a belt loop, fence wire, storage ring or the like. An aperture in the sleeve exposes a portion of the inhaler to display indices, such as the user's initials, uniform number or the like, suitable to distinguish any given inhaler from similar inhalers.

10 Claims, 2 Drawing Sheets

CARRYING CASE FOR AN INHALER

BACKGROUND OF THE INVENTION

This invention relates generally to aerosol inhalers which dispense medication dispersed in a propellant and more particularly concerns personalized carrying cases for the inhalers together with the canister of medication and propellant they dispense.

Asthma is, unfortunately, an all too common respiratory disorder. Fortunately, most asthmatics are able to perform, some at the highest levels of athletic competition, despite this disorder. Usually, relief from an asthma attack is had by inhaling albuterol sulfate dispensed by a propellant such as ethanol from a disposable canister loaded into a personal inhaler. The inhaler, including the loaded canister, generally fits in a small pocket, bag, purse or the like for immediate access as needed. However, the inhaler and disposable canister are independent components and, when jostled during normal activities, the canister can be dislodged from the inhaler. It often occurs, therefore, at the stressful moment of need, that the inhaler and the canister must be separately found and then assembled for use. Furthermore, in special circumstances such as athletic competitions, the inhalers and canisters may not be permitted to be carried on the person or to be present in the immediate area of activity. Consequently, the user must store the inhaler at a convenient location away from the immediate area but quickly accessible when needed. This problem is compounded in the case of team athletics or other events where much equipment and apparel may be stored in the proximate area and especially when a team or group has more than one asthmatic member. In such circumstances, the inhalers must not only be quickly located but also immediately distinguished as belonging to a particular user.

It is, therefore, an object of this invention to provide a carrying case for an inhaler which secures the canister against separation from its loaded condition in the inhaler. Another object of this invention is to provide a carrying case for an inhaler which has a mechanism for attaching and detaching the case containing the inhaler and canister to any of a variety of external objects which may be found in a known and easily accessible location such as a belt loop, fence wire, storage ring or the like. A further object of this invention is to provide a carrying case for an inhaler which displays indicia useful to immediately distinguish a case containing an inhaler and canister which is stored with similar cases containing inhalers and canisters as belonging to a particular user.

SUMMARY OF THE INVENTION

In accordance with the invention, a case is provided for carrying an inhaler holding a cylindrical canister inserted axially into a cylindrical receptacle of the inhaler in transverse relationship to a cylindrical mouthpiece of the inhaler. An elastically radially deformable cylindrical sleeve is resiliently expandable to slidably axially receive the inhaler receptacle through one of its ends. The sleeve grips the inserted inhaler receptacle. An elastically lengthwise deformable strap is fixed at its ends to and extends diametrically across the other end of the sleeve. This strap resiliently stretches to secure the canister against inadvertent release from the receptacle. A mechanism, preferably a spring clip connected to the sleeve by a loop, is also provided for attaching and detaching the case to and from an external object such as a belt loop, fence wire, storage ring or the like.

An aperture in the sleeve exposes a portion of the exterior surface of the receptacle so that suitable indicia can be adhered to the exposed portion of the receptacle surface to distinguish any given inhaler from similar inhalers. Such indicia might, for example, include the user's initials, uniform number or the like.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
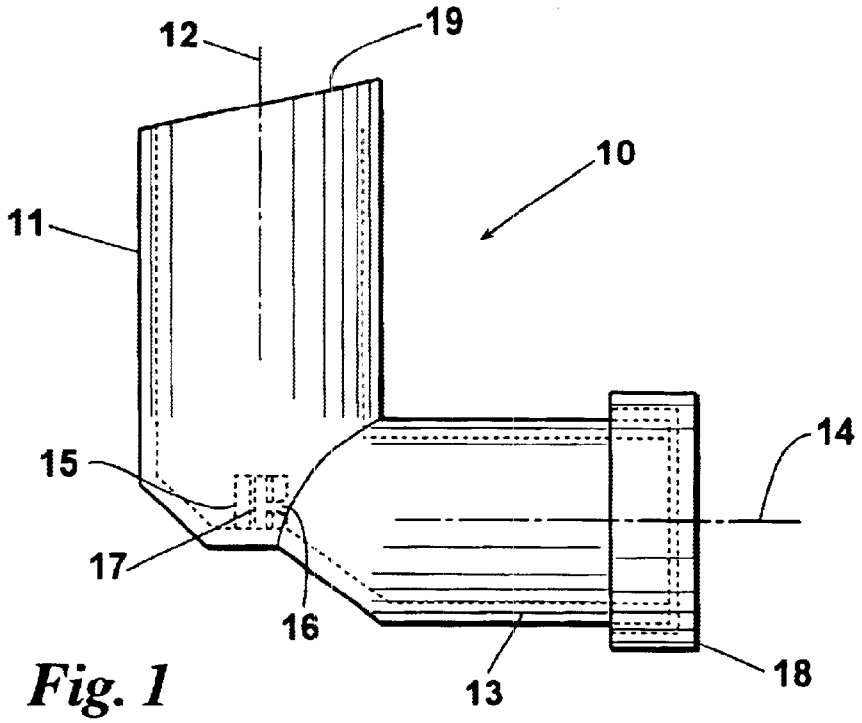
Fig. 1 ( PRIOR ART )
FIG. 1 is a side elevation view of a typical inhaler.

Turning first to FIG. 1, a typical known inhaler 10 is illustrated. The inhaler 10 consists of a cylindrical receptacle 11 aligned on a longitudinal receptacle axis 12 and a cylindrical mouthpiece 13 aligned on a longitudinal axis 14 transverse to the receptacle axis 12. A valve seat 15 in the bottom of the receptacle 11 has a discharge port 16 aligned with the mouthpiece axis 14. The valve seat 15 is lined with a soft bushing 17 and the open end of the mouthpiece 13 is protected by an end cap 18.

Figure 2:
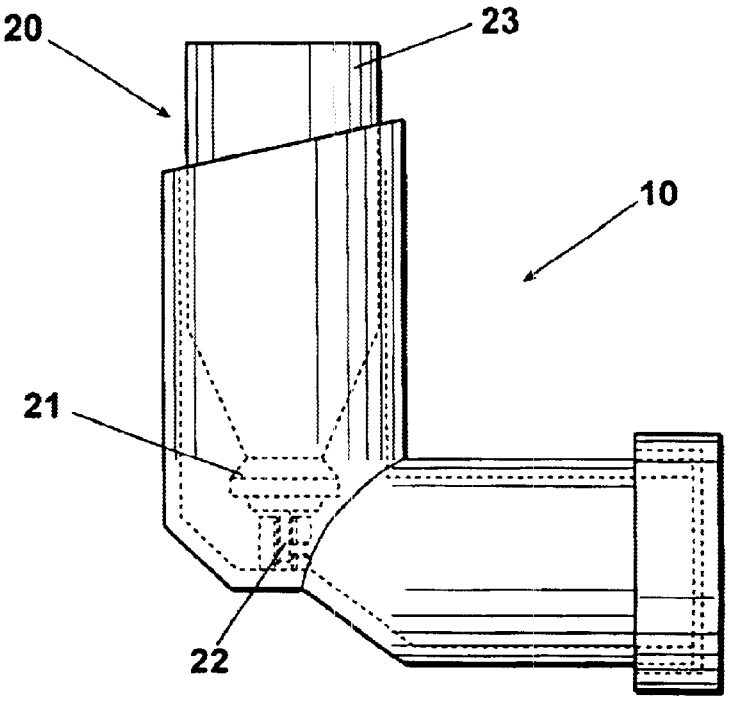
Fig. 2 ( PRIOR ART )
FIG. 2 is a side elevation view of the inhaler of FIG. 1 with a typical medicament canister loaded therein.

Looking now at FIG. 2, the inhaler 10 of FIG. 1 is illustrated holding a known canister 20. Typically, the canister 20 contains albuterol sulfate suspended in a propellant such as ethanol. The canister 20 has a discharge valve 21 with a valve stem 22. As shown, the canister 20 has been inserted valve end first into an open end 19 of the inhaler receptacle 11 and pressed down until the valve stem 22 is somewhat firmly seated in the soft bushing 17 of the valve seat 15. The other end 23 of the canister 20 extends exposed above the open end 19 of the inhaler receptacle 11. The discharge valve 21 is operated by pressing downwardly on the exposed end 23 of the canister to force the stem 22 into the valve 21, thus opening the valve 21 and discharging the contents of the canister 20 through the discharge port 16 into the mouthpiece 13 of the inhaler 10. When the pressure on the end 23 of the canister 20 is released, the canister 20 moves upwardly to close the valve 21.

Since the discharge valve 21 is opened and closed by the downward and upward reciprocal movement, respectively, of the canister 20 in the inhaler receptacle 11, the canister 20 cannot be gripped tightly by the inhaler receptacle 11. The canister 20 is held in place solely by the engagement of the valve stem 22 in the bushing 17 of the valve seat 15. Consequently, when the loaded inhaler is bumped, bounced, jostled or otherwise roughly handled, the canister 20 is relatively easily inadvertently separated from the inhaler 10.

Figure 5:
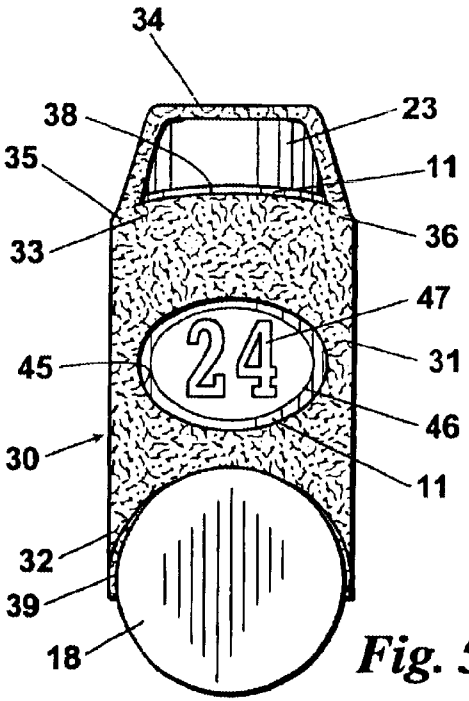
FIG. 5 is a front elevation view of the case, canister and inhaler of FIG.
Figure 4:
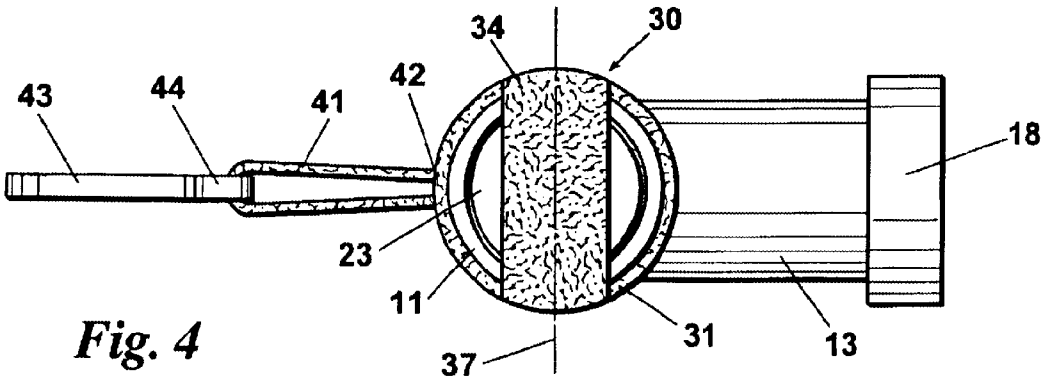
FIG. 4 is a top plan view of the case, canister and inhaler of FIG. 3.
Figure 3:
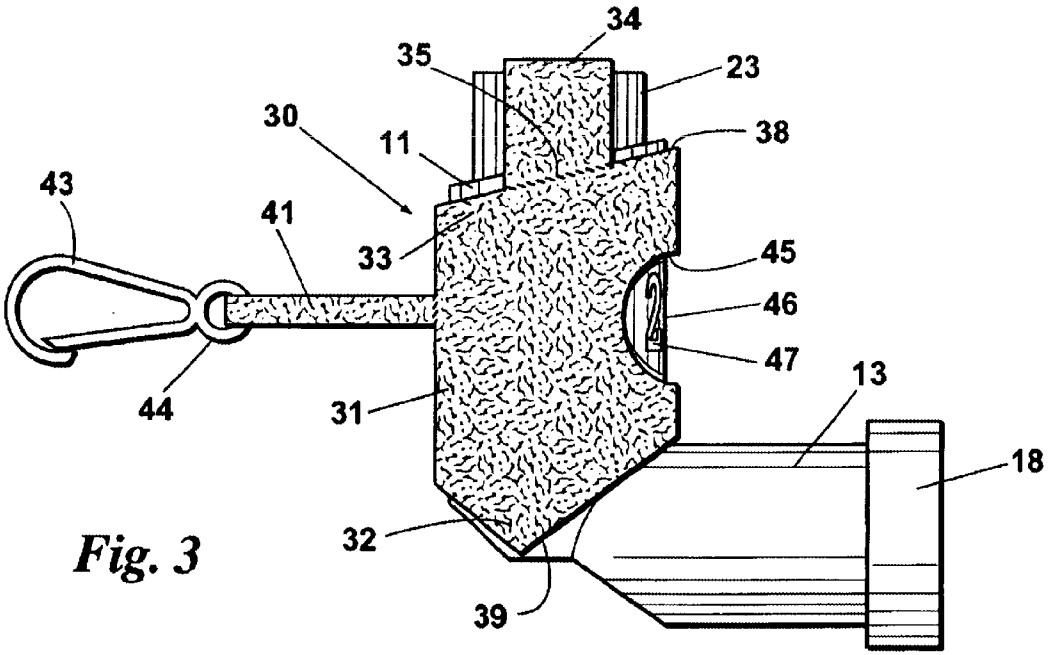
FIG. 3 is a side elevation view of a preferred embodiment of the carrying case securing the canister in the inhaler of FIG. 2.

Turning now to FIGS. 3–5, a case 30 is shown which is useful for maintaining the canister 20 in its loaded position in the cylindrical receptacle 11 of the inhaler 10. The case 30 has a cylindrical sleeve 31 which is elastically radially deformable or stretchable to grip the outerwall of the cylindrical receptacle 11. The lower end 32 of the sleeve 31 is open so that the sleeve 31 can slide over the upper end 23 of the canister 20 and the upper end 19 of the inhaler receptacle 11. The upper end 33 of the sleeve 31 is also open. However, an elastically lengthwise deformable strap 34 is fixed at its ends 35 and 36 to the upper end 33 of the sleeve 31. The strap 34 extends and stretches diametrically 37 across the exposed end 23 of the canister 20. Thus, the elastic and frictional grip of the sleeve 31 secures the sleeve 31 in place on the inhaler receptacle 11 and the stretched strap 34 secures the canister 20 in place in the receptacle 11. In order to maximize the frictional and elastic grip of the sleeve 31 on the receptacle 11, the top and bottom cuts 38 and 39, respectively, can be made to conform to the contour of the receptacle 11, thus increasing or maximizing the area of contact between the sleeve 31 and the receptacle 11.

Continuing to look at FIGS. 3 and 4, the utility of the case 30 is enhanced by the addition of a loop 41 fixed at one end 42 to the sleeve 31. A spring clip 43 has its eye 44 engaged on the loop 41. Thus, for convenient and rapid location of the inhaler 10, the clip 43 can be attached to a belt loop, purse string, fence wire, or any other suitable external object readily accessible to the user.

The utility of the case 30 can be even further enhanced by provision in the sleeve 31 of an aperture 45, best seen in FIGS. 3 and 5. The aperture 45 exposes a portion of the receptacle 11 in which a label 46 can be disposed displaying indicia 47 such as a player number or initials which can be easily observed so as to identify the inhaler 10 to its appropriate user. Thus, in any situation in which several persons might require the use of their own personal inhalers 10, such as at an athletic competition or the like, each of the inhalers 10 and their respective canisters 20 can be connected by use of individual cases 30 to another object in a common location known to coaches, players and/or trainers.

As shown, the aperture 45 and the loop 41 are diametrically opposed to each other on the sleeve 31 on a diameter transverse to the diametric alignment 37 of the strap 34. While this alignment is preferred, the aperture 45 and loop 41 may be positioned anywhere on the sleeve 31. The sleeve 31 may be made of any material which is elastically radially deformable so as to grip the receptacle 11 and the strap 34 may be of any elastically lengthwise deformable material so that the strap 34 holds the canister 20 in place in the receptacle 11. In the prototype device, neoprene of approximately 1/16" to 3/32" was found to be suitable. Also in the prototype, the sleeve 31 and the attachments of the strap 34 and loop 41 to the sleeve 31 were accomplished by stitching. The indicia 47 can be applied by, for example, permanent ink writing directly on the exposed surface of the receptacle 11 or by the use, for example, of an adhesive backed writing surface 46 which can be adhered to the exposed portion of the receptacle 11, to which the indicia 47 can then be applied.

Thus, it is apparent that there has been provided, in accordance with the invention, a carrying case for an inhaler that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For an inhaler holding a cylindrical canister inserted axially into a cylindrical receptacle of the inhaler in transverse relationship to a cylindrical mouthpiece of the inhaler, a carrying case comprising an elastically radially deformable cylindrical sleeve resiliently expandable to slidably axially receive the inhaler receptacle through one end thereof and to grip the inhaler receptacle therein and an elastically lengthwise deformable strap fixed at ends thereof to and extending diametrically across another end of said sleeve and resiliently stretchable to secure the canister against inadvertent release from the receptacle.

2. A carrying case according to claim 1 further comprising means fixed to and extending outwardly from said sleeve for attaching and detaching said case to an external object.

3. A carrying case according to claim 2, said attaching and detaching means comprising a spring clip connected to said sleeve by a loop.

4. A carrying case according to claim 1 further comprising an aperture in said sleeve for exposing a portion of an exterior surface of the receptacle.

5. A carrying case according to claim 4 further comprising indicia adherable to the exposed portion of the receptacle surface to distinguish the inhaler from similar inhalers.

6. A combination comprising an inhaler having a cylindrical receptacle in transverse relationship to a cylindrical mouthpiece extending from one end of said receptacle, a cylindrical canister inserted axially into another end of said receptacle, a radially elastically deformable cylindrical sleeve gripping said inhaler receptacle therein and a lengthwise elastically deformable strap fixed at ends thereof to and extending diametrically across said another end of said sleeve and resiliently stretched across an end of said canister to secure said canister against inadvertent release from said receptacle.

7. A combination according to claim 6 further comprising means fixed to and extending outwardly from said sleeve for attaching and detaching said case to an external object.

8. A combination,according to claim 7, said attaching and detaching means comprising a spring clip connected to said sleeve by a loop.

9. A combination according to claim 6 further comprising an aperture in said sleeve for exposing a portion of an exterior surface of said receptacle.

10. A combination according to claim 9 further comprising indicia adherable to said exposed portion of said receptacle surface to distinguish said inhaler from similar inhalers.

* * * * *